US007352094B2

(12) United States Patent
Winkler

(10) Patent No.: US 7,352,094 B2
(45) Date of Patent: Apr. 1, 2008

(54) EQUIPMENT FAN

(75) Inventor: Wolfgang Arno Winkler, St. Georgen (DE)

(73) Assignee: ebm-papst St. Georgen, GmbH & Co., KG, St. Georgen (DE)

( * ) Notice: Subject to any disclaimer, the term of this patent is extended or adjusted under 35 U.S.C. 154(b) by 415 days.

(21) Appl. No.: 10/982,307

(22) Filed: Nov. 5, 2004

(65) Prior Publication Data

US 2005/0077792 A1 Apr. 14, 2005

(51) Int. Cl.
*H02K 5/04* (2006.01)
*H02K 9/04* (2006.01)

(52) U.S. Cl. ..... 310/89; 310/71

(58) Field of Classification Search ..... 318/138, 318/254, 439, 720–724; 417/423.14; 310/71, 310/89

See application file for complete search history.

(56) References Cited

U.S. PATENT DOCUMENTS 4,554,491 A * 11/1985 Plunkett ..... 318/254
4,612,468 A 9/1986 Sturm ..... 310/67 R
4,698,542 A * 10/1987 Muller ..... 310/67 R
4,949,022 A * 8/1990 Lipman ..... 318/254
5,001,642 A 3/1991 Botzenhardt ..... 364/431.12
5,099,181 A * 3/1992 Canon ..... 318/254
5,208,730 A * 5/1993 Tracy ..... 361/687
5,631,800 A 5/1997 Jin et al. ..... 361/103
5,638,895 A * 6/1997 Dodson ..... 165/121
5,695,318 A 12/1997 Harmsen ..... 415/218.1
5,845,045 A 12/1998 Jeske ..... 388/804

(Continued)

FOREIGN PATENT DOCUMENTS

DE 34 04 466 C2 8/1985

(Continued)

OTHER PUBLICATIONS

U.S. Appl. No. 09/719,440, filed Aug. 2000, Karwath et al.

(Continued)

*Primary Examiner*—Bentsu Ro
(74) *Attorney, Agent, or Firm*—Milton Oliver, Esq.; Ware Fressola Van Der Sluys & Adolphson LLP

(57) ABSTRACT

An improved fan useful for ventilating applications in motor vehicles features a modular structure, which facilitates quick replacement of any components likely to fail. A first module (110) is intended for permanent installation on the part that is to be cooled. A second module (110) is configured for quick engagement to and disengagement from the first module. The second module preferably comprises a hub (22; 362), an internal stator (60; 332) mounted on the hub, and one or more struts (74; 344) connecting the hub to a cylindrical casing part (76; 336) which surrounds but is spaced from the outside of the fan wheel (46; 348). The struts form a lattice (112) which can be easily grasped for swapping out the second module when repair or replacement becomes necessary. The fan has a Hall sensor (50) and a control circuit (156) which regulates fan speed according to PWM (Pulse Width Modulation) or DC voltage signals (164) supplied from outside and has means (186; 244) for generating a fault signal in the event of a fault state, and for sending the fault signal out on a control line (90).

30 Claims, 9 Drawing Sheets

U.S. PATENT DOCUMENTS

| | | | | |
|---|---|---|---|---|
| 5,902,014 | A | 5/1999 | Dinkel | 297/452.43 |
| 5,934,748 | A | 8/1999 | Faust | 297/180.12 |
| 5,947,691 | A * | 9/1999 | Brown et al. | 417/44.1 |
| 5,977,733 | A | 11/1999 | Chen | 318/434 |
| 6,049,183 | A | 4/2000 | Lin | 318/434 |
| 6,075,698 | A * | 6/2000 | Hogan et al. | 361/695 |
| 6,147,465 | A * | 11/2000 | Hollenbeck | 318/254 |
| 6,262,549 | B1 | 7/2001 | Yang et al. | 318/463 |
| 6,376,946 | B1 * | 4/2002 | Lee | 310/67 R |
| 6,619,736 | B2 | 9/2003 | Stöwe et al. | 297/180.14 |
| 6,674,369 | B1 | 1/2004 | Riddoch | 340/648 |
| 6,690,576 | B2 * | 2/2004 | Clements et al. | 361/695 |
| 6,695,046 | B1 | 2/2004 | Byrnes et al. | 165/247 |
| 6,747,424 | B1 | 6/2004 | Malik et al. | 318/254 |
| 2001/0028185 | A1 | 10/2001 | Stowe et al. | |
| 2002/0070327 | A1 | 6/2002 | Hsieh | 248/560 |

FOREIGN PATENT DOCUMENTS

| | | | |
|---|---|---|---|
| DE | 41 27 134 | | 2/1993 |
| DE | 41 41 106 | A1 | 6/1993 |
| DE | 200 14 004 | U1 | 12/2000 |
| DE | 100 09 128 | C1 | 8/2001 |
| EP | 0 345 796 | B1 | 12/1989 |
| EP | 0 657 989 | A | 6/1995 |
| EP | 1 000 783 | | 5/2000 |
| EP | 1 127 737 | A1 | 8/2001 |
| GB | 2168756 | | 6/1986 |
| WO | WO 99-09642 | | 2/1999 |

OTHER PUBLICATIONS

Papst-Motoren KG, brochure entitled "Neue Lüfter & Gebläse für Gleichspannung" (New Fans & Blowers for DC Applications), published Feb. 13, 1979, St. Georgen, Germany, pp. 1-2.

Robert Bosch GmbH, *Automotive Handbook*, 3rd Edition (VDI Verlag 1993), pp. 776-778, section entitled "Controller Area Network."

Derwent WPI English abstract of DE 34 04 466-C2, published Aug. 8, 1985.

Derwent WPI English abstract of DE 41 41 106-A1 & EP 546 508-A1, published Jun. 17, 1993.

* cited by examiner

EQUIPMENT FAN

FIELD OF THE INVENTION

The invention concerns, inter alia, an equipment fan having a fan wheel that is driven by an external-rotor motor whose internal stator is mounted on a hub. The invention preferably concerns a fan of this kind that can communicate with an external control device via a control line ("bus").

BACKGROUND

Equipment fans are often installed in inaccessible locations where subsequent replacement of the fan, e.g. for a repair, is very difficult. This applies in particular to land and water vehicles and aircraft.

SUMMARY OF THE INVENTION

It is therefore an object of the invention to provide a modular fan structure which facilitates quick replacement of any failing components.

According to the invention, this object is achieved by providing a housing containing non-wearing components, which releasably engages a replaceable module including an external rotor, fan wheel, a hub, an internal stator mounted on the hub, and at least one strut connecting the hub to a cylindrical casing. In a fan of this kind, the housing can be mounted on an object that is to be ventilated, since it usually contains only mechanical parts that are not subject to wear. The component having the fan wheel, external-rotor motor, and casing part, on the other hand, can easily be detached from said housing as necessary, and repaired or replaced with a new component of identical type. An exchange of this kind can be made in a very short period of time, so that damage due to failure of a fan does not result in extended downtime of the equipment being cooled by it.

Another manner of achieving the stated object is to equip the motor with at least one signal line, through which control signals can be fed from outside to the motor, and through which a fault signal can be fed back from the motor to the outside, so that something can be done about the fault state. It enables rapid fault detection, and thus efficient replacement of a defective fan once a fault has been detected.

Further details and advantageous refinements of the invention are evident from the exemplary embodiments, which are described below and depicted in the drawings, but which are not to be construed as a limitation of the invention.

BRIEF FIGURE DESCRIPTION

DETAILED DESCRIPTION OF THE PREFERRED EMBODIMENTS

Figure 1:
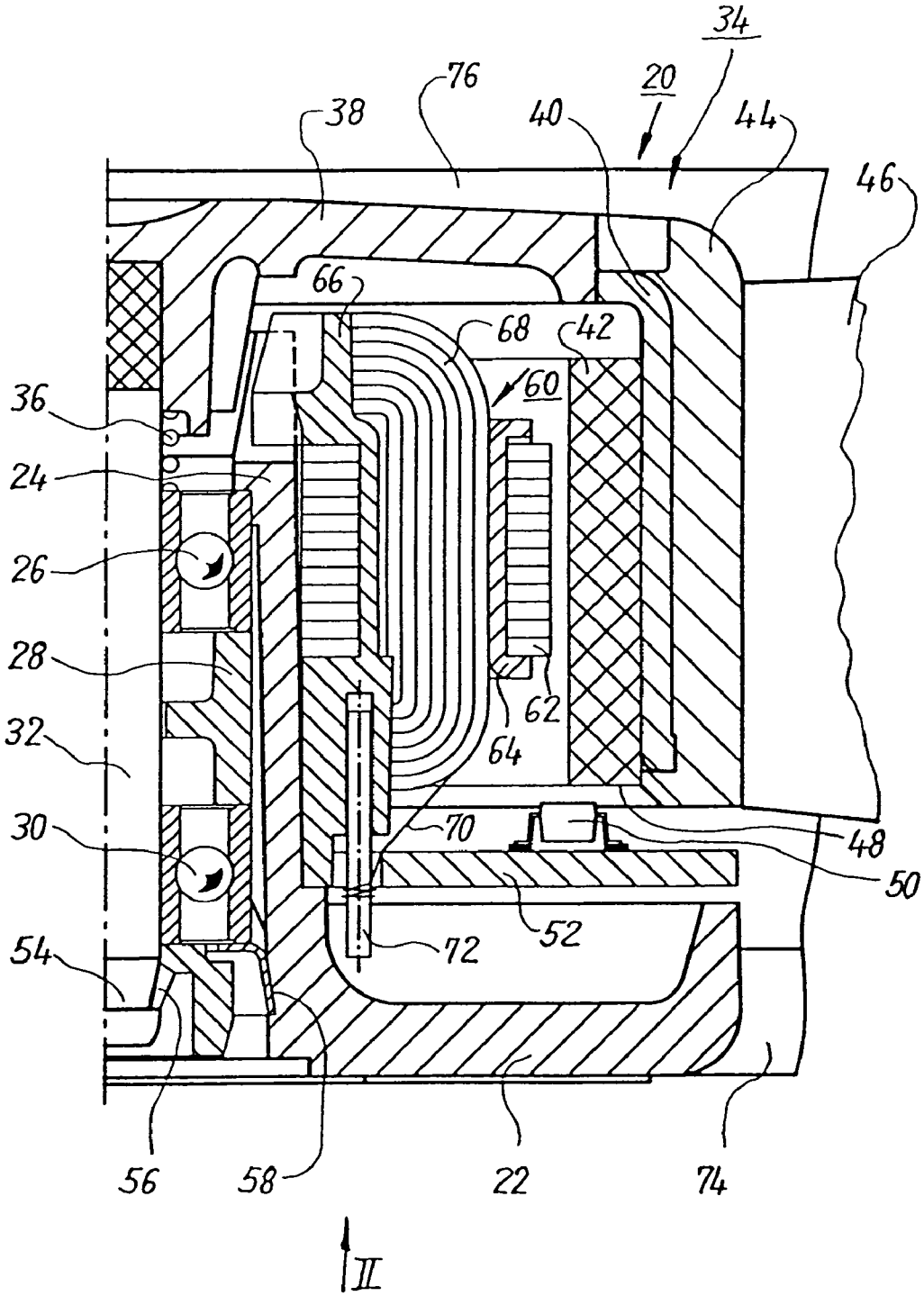
FIG. 1 is an enlarged section through the right half of a first exemplary embodiment of a fan according to the invention.

FIG. 1 shows a greatly magnified section through the right half of an external-rotor motor 20, the left half being essentially mirror-symmetrical thereto. To save drawing space, fan blade 46 and strut 74 are shown broken away. The motor has a hub 22, made of a suitable plastic, that is configured integrally with a bearing support tube 24 in which an upper ball bearing 26, a spacer 28 for the outer races, and a lower ball bearing 30 are arranged, which ball bearings support central shaft 32 of an external rotor 34. The inner races of ball bearings 26, 30 are braced against one another by a compression spring 36 that is arranged between the inner race of ball bearing 26 and a rotor part 38. The latter, as depicted, is mounted at the upper end of shaft 32 and carries a ferromagnetically soft ring 40 in which a rotor magnet 42 is arranged. Extending around ring 40 is an annular part 44 made of plastic, which is configured integrally with five fan blades 46. Opposite lower end 48 of rotor magnet 42, a Hall IC (Integrated Circuit) 50 is arranged on a circuit board 52 that carries electronic components for controlling motor 20 and for fault reporting. Hall IC 50 controls the current in motor 20 and serves as the sensor for its rotation speed.

Central shaft 32 has, at its lower end, an annular groove 54 into which a holding part 56, which is immobilized by means of a leaf spring 58 in bearing support tube 24, resiliently engages.

An internal stator 60 is mounted on the outer side of bearing support tube 24. The stator has a lamination stack 62 in which a winding 68 is mounted by means of a coil carrier 64, 66. One terminal 70 of winding 68 is depicted. It is soldered to a pin 72 that is mounted in coil former 66.

Figure 2:
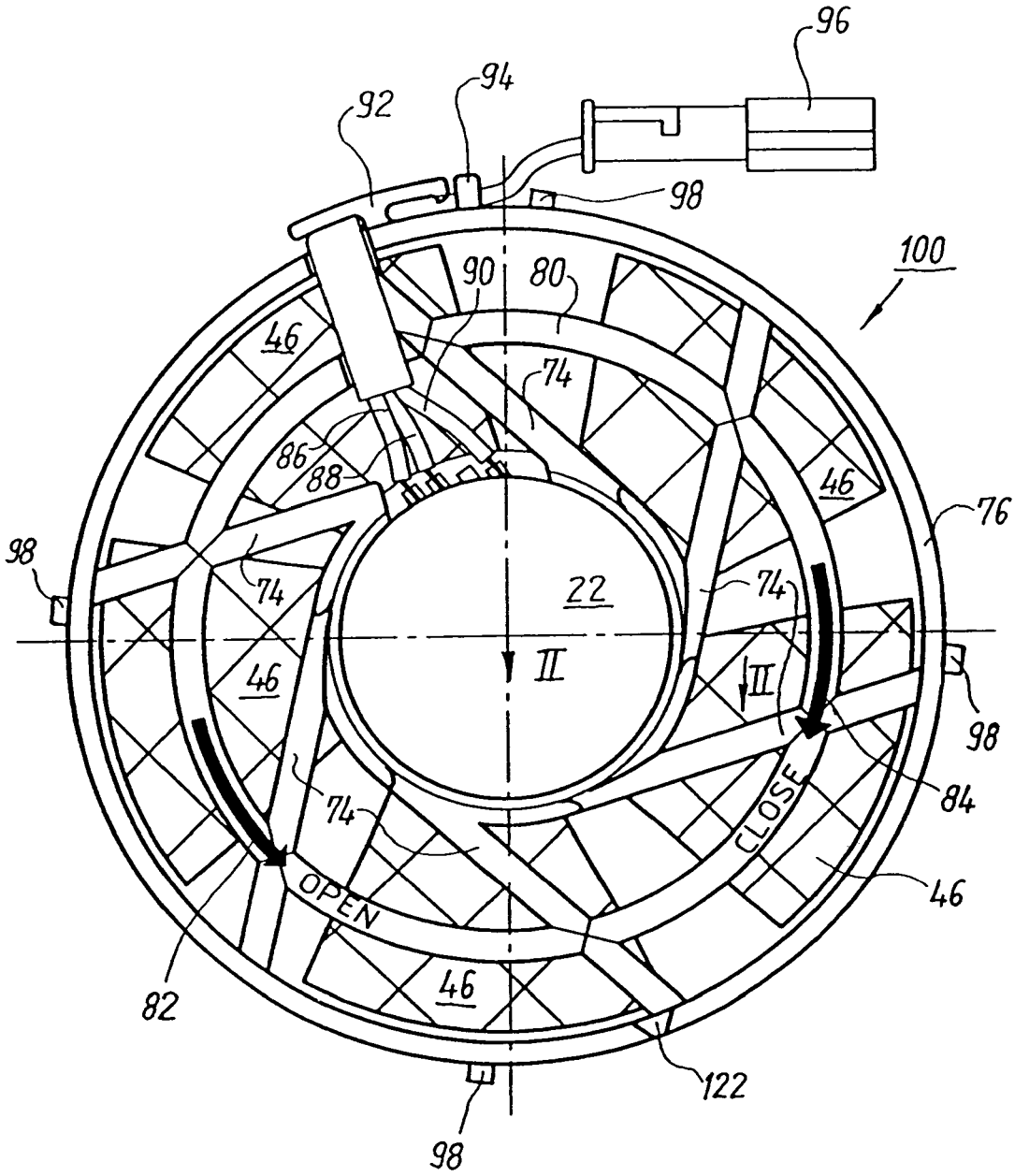
FIG. 2 is a plan view, viewed in the direction of arrow II of FIG. 1.
Figure 7:
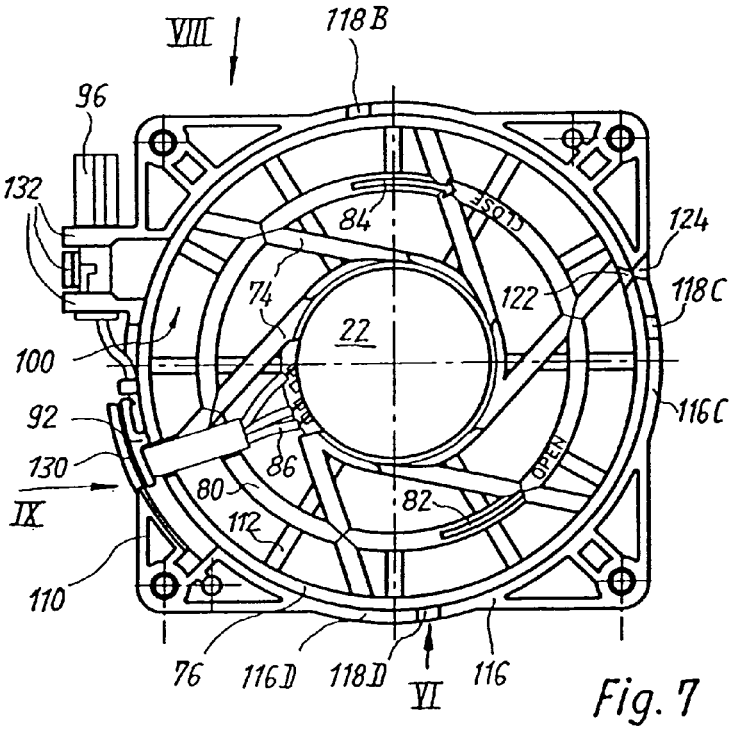
FIG. 7 is a plan view of the complete fan, viewed in the direction of arrow VII of FIG. 6.
Figure 9:
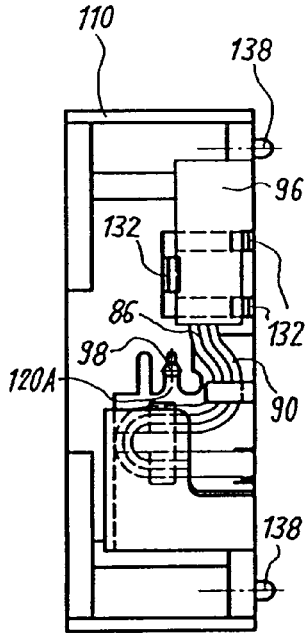
FIG. 9 is a side view of the complete fan, viewed in the direction of arrow IX of FIG. 7.
Figure 6:
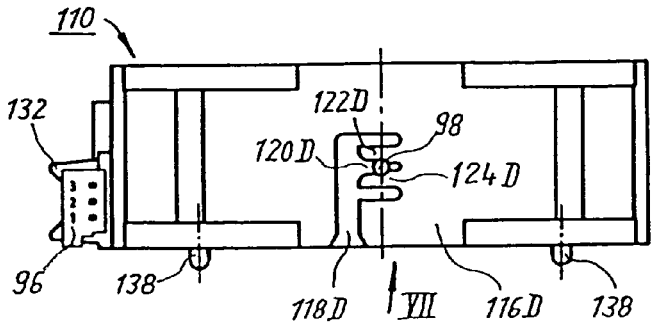
FIG. 6 is a side view of the complete fan, viewed in the direction of arrow VI of FIG. 7.

Hub 22 is configured integrally with struts 74 which join hub 22 to a substantially cylindrical casing part 76 that surrounds fan blades 46 radially with a spacing (cf. FIG. 2). Struts 74 form a protective lattice that is depicted in FIGS. 2 and 7 and that also serves as a grasping aid for inserting motor 20 into a housing (FIGS. 3 through 5) or removing it therefrom.

FIG. 2 shows a plan view in the direction of arrow II of FIG. 1. It is evident that six struts 74 are mounted on hub 22, and join hub 22 to casing part 76. Hub 22, struts 74, and casing part 76 are configured as an integral plastic part. Approximately at their midpoints, struts 74 are joined to one another by an annular strut 80 on which are applied an arrow 82 for the opening direction and an arrow 84 for the closing direction, as well as corresponding labels (OPEN, CLOSE).

Three connecting lines 86, 88 (+ and −) and 90 (control line) are soldered on in the region of hub 22, and guided from there via a T-shaped clamp part 92 on the outer side of casing part 76 and a further clamping part 94, also on the outer side of casing part 76, to a connector plug 96. Also located on the outer side of casing part 76 are four radially protruding pegs 98 which serve as snap-lock pegs and are here arranged at equal spacings of 90 degrees.

The module depicted in FIGS. 1 and 2, made up of external-rotor motor 20, fan blades 46, and tubular casing 76, is labeled 100. It constitutes a replaceable module which, in the event of a fault, can be quickly replaced as a complete unit with no need to remove the fan housing for that purpose.

Figure 4:
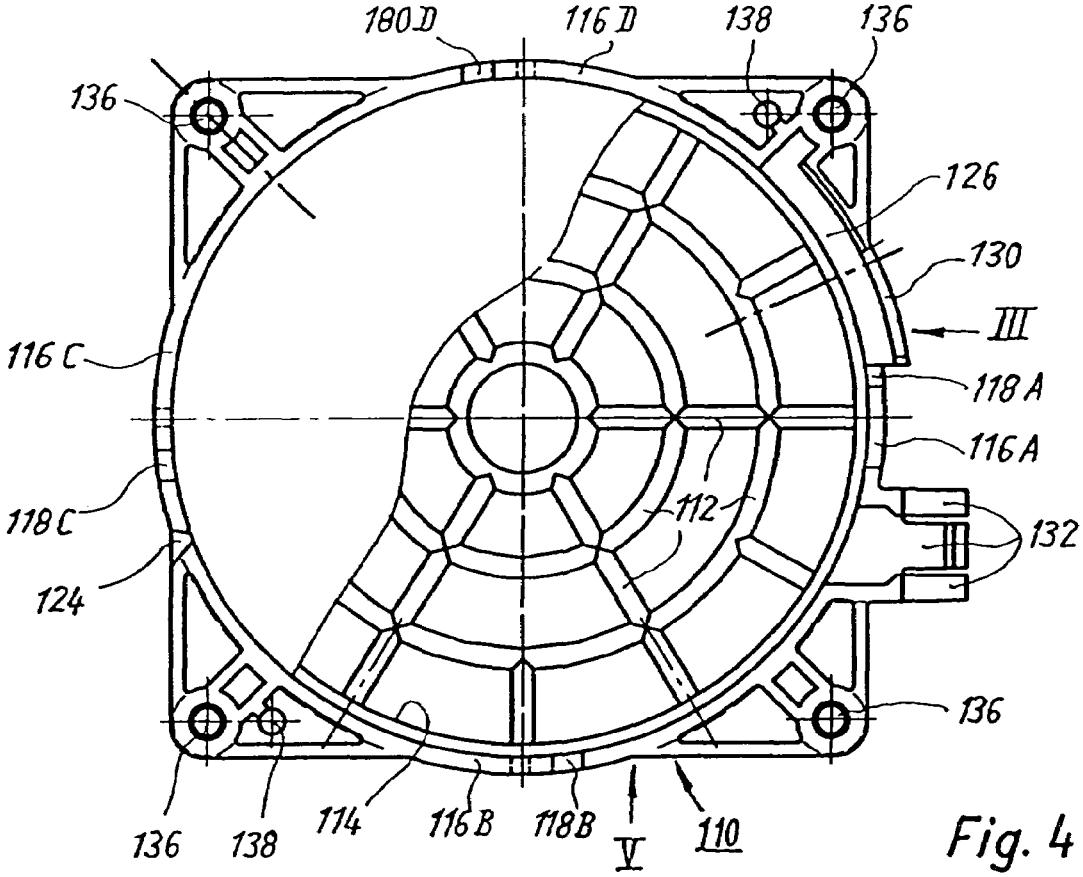
FIG. 4 is a plan view of housing part 110, viewed in the direction of arrow IV of FIG. 5.

FIG. 4 is a plan view of the open side of a fan housing 110. The latter has at its bottom a protective lattice 112 that is configured integrally with housing 110, and it has a substantially cylindrical opening 114 for receiving the cylindrical casing part 76 (FIG. 2). The contour of housing 110 is substantially square, e.g. having the standard dimensions 80×80 mm, but a thin-walled casing part 116 in which opening 114 is configured protrudes locally beyond this square contour. Openings 118A, 118B, 118C, 118D for the reception of pegs 98 (FIG. 2) are provided in these protruding parts 116A through 116D.

Figure 3:
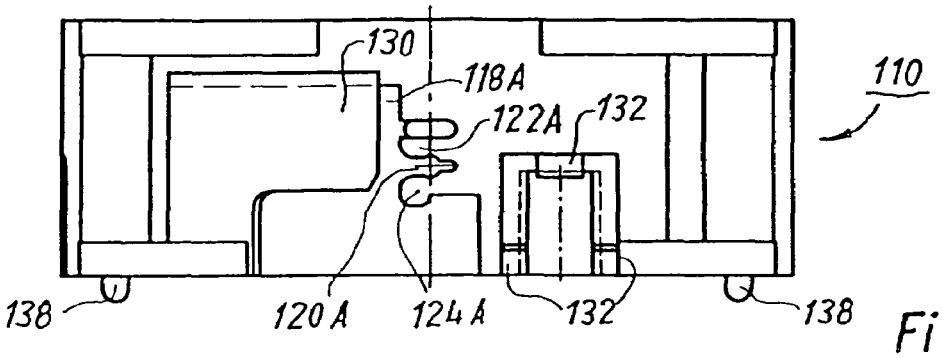
FIG. 3 is a side view of housing part 110 of FIG. 4, viewed in the direction of arrow III of FIG. 4.

FIG. 3 depicts opening 118A which is at the right side in FIG. 4, and which transitions laterally into a latch opening 120A that has on the one side a resilient latch tongue 122A and on the other side a resilient latch tongue 124A.

Figure 5:
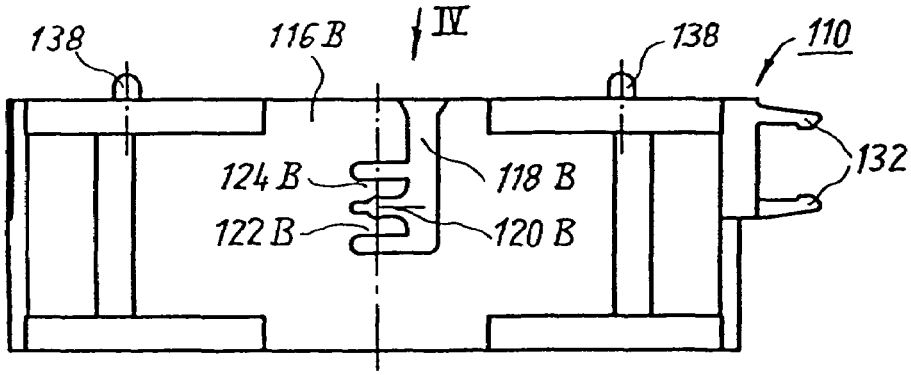
FIG. 5 is a side view of housing part 110, viewed in the direction of arrow V of FIG. 4.
Figure 8:
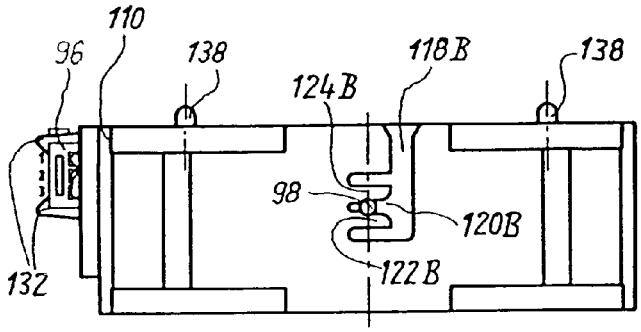
FIG. 8 is a side view of the complete fan, viewed in the direction of arrow VIII of FIG. 7.

FIG. 5 depicts opening 118B that is at the bottom in FIG. 4. It transitions laterally into a latch opening 120B that has on the one side a resilient latch tongue 122B and on the other side a resilient latch tongue 124B. The other openings 118C and 118D are identical in configuration to opening 118B, and the reference characters used for them are therefore identical, but have the letters C and D, respectively, added.

In order to receive lines 86, 88, and 90, T-shaped part 92, and clamping part 94, cylindrical opening 114 has a radial enlargement 126 that extends over an angle of approximately 20 degrees. The cover of this enlargement is labeled 130 and is depicted in FIG. 3. Latching members 132 for the mounting of plug 96 are located next to this cover (FIG. 2).

Housing 110 has, at its corners, holes 136 for permanent mounting of this part onto a component that is to be cooled, e.g. a transmitter device; and it has two projecting pegs 138 for precisely fitted retention.

Housing 110 is permanently installed on the part that is to be cooled. Module 100 (FIG. 2) can then be inserted, after installation, into housing 110 and removed therefrom again if necessary, e.g. for repair.

FIGS. 6 through 9 show the fan in its complete state and at approximately actual size. Module 100 is inserted into housing 110 and latched therein. This is done by pushing pegs 98 axially into openings 118A-118D and then rotating module 100 a few degrees clockwise in the direction of arrow 84 (CLOSE). Pegs 98 thus snap into latch openings 120A-120D, as shown clearly by FIGS. 6, 8, and 9. Plug 96 is then snapped onto latching members 132, as depicted in FIGS. 6 through 9.

Removal of module 100 from housing 110 proceeds in the opposite sequence, i.e. module 100 is rotated a few degrees counterclockwise in the direction of arrow 82, and then pulled axially out of housing 110.

As depicted in FIG. 7, a mark 122 is provided on casing part 76 and a mark 124 on casing part 116C, and marks 122, 124 point toward one another when module 100 is correctly latched. This permits easy visual inspection at the acceptance check.

For rotation of module 100, the openings between radial struts 74 and annular strut 80 are configured so that a person's fingers can be introduced into these openings and the protective lattice can be used as a grasping aid. Be it noted that protective lattice 112 depicted in FIG. 4 is arranged on one side of the complete fan, and protective lattice 74, 80 is arranged on the other side of the fan, so that the latter has a protective lattice on both sides, the two protective lattices preferably being made of plastic. Protective lattice 112 is configured integrally with housing 110, and protective lattice 74, 80 integrally with tubular casing 76 and hub 22.

Figure 10:
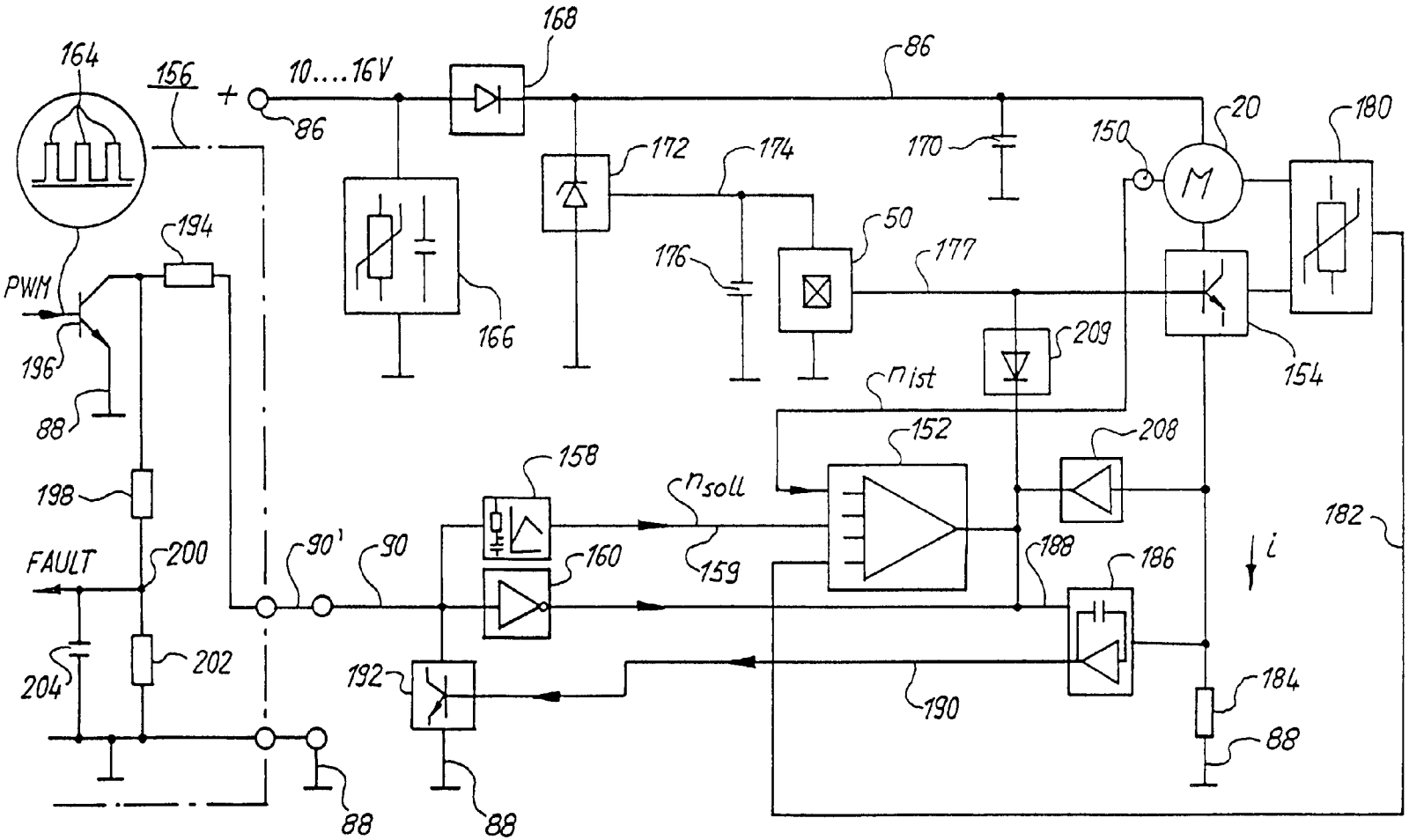
FIG. 10 is a block diagram of a preferred circuit for remote control of a fan according to the invention via a control line (bus)

FIG. 10 shows an associated circuit. Motor 20 is depicted schematically on the right. It generates, by means of an apparatus 150, i.e tacho-generator, a signal that corresponds to the actual rotation speed $n_{ist}$, which is applied to a rotation speed controller 152. Motor 20 is connected, in series with an output stage 154, between lines 86 (+) and 88 (ground).

Figure 11:
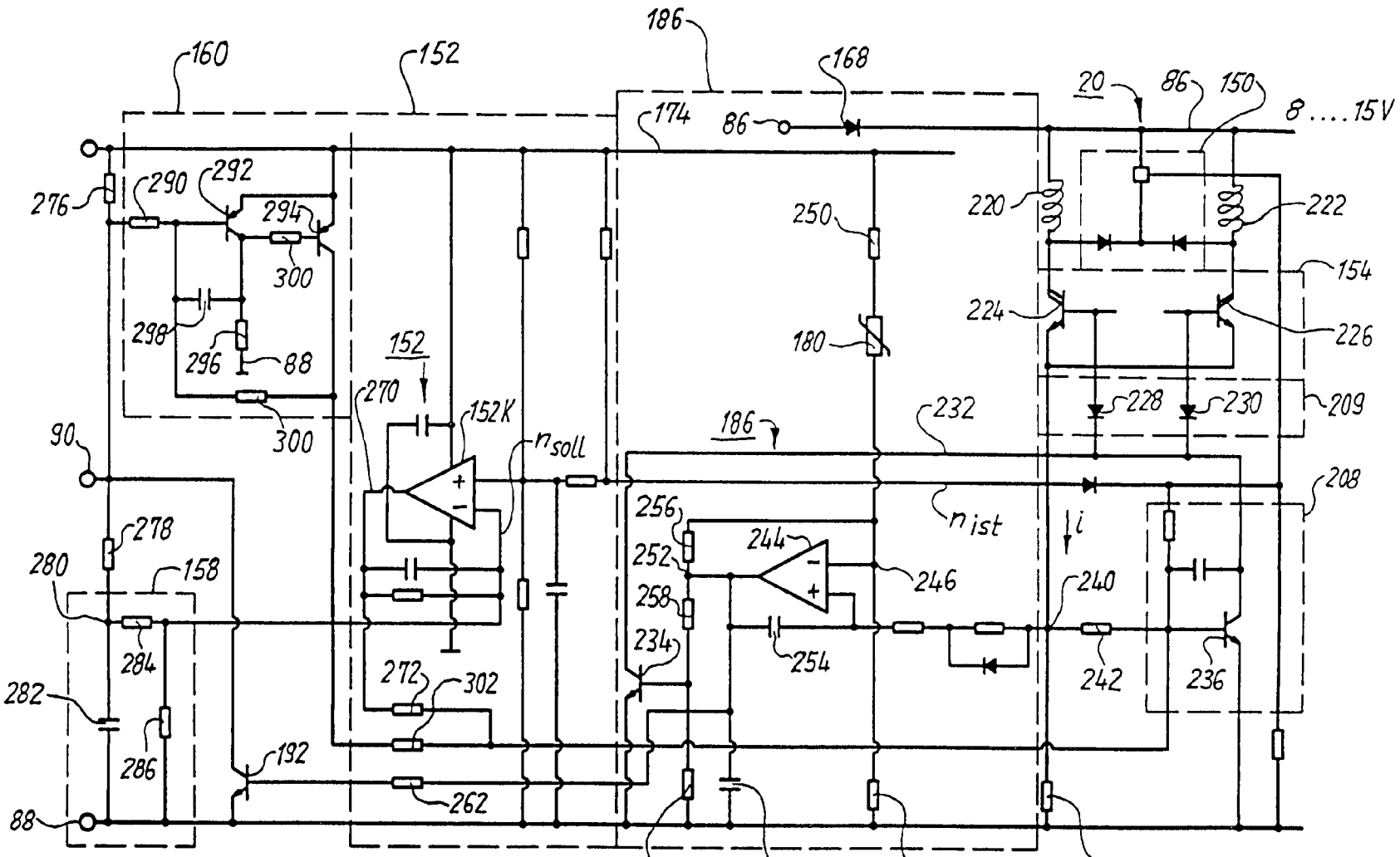
FIG. 11 is a circuit diagram similar to FIG. 10, with further details.

In FIG. 10, output stage 154 is depicted symbolically as an npn transistor In FIG. 11, it is constituted by the two transistors 224, 226. Motor 20 is controlled by a control device 156 that serves in general to make available an actuating signal for motor 20 and to evaluate a fault signal from motor 20. Control device 156 can supply a PWM (Pulse Width Modulation) signal or a DC voltage control signal as the actuating signal.

What serves to control the rotation speed of motor 20 is thus a DC voltage signal, or a PWM signal 164, that is delivered by control device 156 via control line 90 to motor 20, converted there by a filter 158 into a DC voltage on a line 159, and conveyed to rotation speed controller 152 as target value $n_{soll}$. Alternatively, control can also be accomplished by means of a DC voltage that is conveyed to input 90 and can have values, for example, between 2 and 7 V. DC voltage $n_{soll}$ on line 159 increases as the pulse duty factor pwm of PWM signal 164 rises. The following conditions apply:

| | |
|---|---|
| pwm < 10% | Fan off |
| pwm = 30-85% | Working range of motor 20 |
| pwm > 95% | Fan off. |

If connection 90' from control device 156 to control line 90 is interrupted, rotation speed controller 152 would continuously receive a signal that would correspond to a PWM signal 164 having a pulse duty ratio of 100%, and motor 20 would run at maximum speed. To prevent this, a switching member 160 is provided that blocks output stage 154 in such a case, so that motor 20 receives no current and is shut off. The same is true of a pulse duty factor >95% that is conveyed to control line 90, and is also interpreted as a shutoff signal.

If the fan is used in a motor vehicle, terminal 86 is connected to the positive pole of the vehicle battery (not depicted). Terminal 86 is connected to a filter 166 for EMI (electro-magnetic interference) protection, and a diode 168 is provided for protection against incorrect connection to the battery. Also provided is a capacitor 170 that supplies motor 20 with reactive power.

A stabilized voltage of e.g. +7.7 V is generated on line 174 by way or an internal constant-voltage source 172, and is filtered by a capacitor 176. Hall IC 50, which is controlled by permanent-magnet rotor 42 (FIG. 1) and in turn controls output stage 154 via a connection 177 as a function of the position of said rotor, is connected to line 174.

A PTC (Positive Temperature Coefficient) resistor 180, whose output signal is conveyed via a line 182 to rotation speed controller 152 and controls the latter to a rotation speed of zero if the temperature of motor 20/output stage 154 exceeds a value that is critical for all components, e.g. 115 degrees C., is provided in thermal communication with motor 20 and output stage 154 (or with the two transistors 224, 226 in FIG. 11).

Provided in the connection from output stage 154 to ground 88 is a measuring resistor 184 at which there occurs, during operation, a voltage which is dependent on the current i of motor 20 and is conveyed to a control member 186.

If the voltage at resistor 184 becomes too high, control member 186 then generates at an output 188 a signal which blocks output stage 154 for e.g. 13 seconds, and it generates at an output 190 a signal which is conveyed to an npn transistor 192 and makes the latter conductive.

The emitter of transistor 192 is connected to ground 88, and its collector to control line 90; i.e. when transistor 192 is conductive, control line 90 acquires approximately the potential of ground 88.

In control unit 156, line 90, 90' is connected via a resistor 194 to the collector of an npn transistor 196 whose emitter is connected to ground 88 and to whose base the depicted PWM signal 164 is conveyed during operation.

When control line 90 is connected through transistor 192 to ground 88, the effect is the same as if PWM signal 164 had a pulse duty ratio of 0%, and motor 20 is shut off. The same is true when a DC control voltage conveyed to input 90 assumes a value of zero.

In this context, the collector of transistor 196 is connected via a resistor 198 to a node 200, and the latter is connected to ground 88 via a resistor 202 and a capacitor 204 connected in parallel therewith.

In normal operation, capacitor 204 becomes charged by the pulses of PWM signal 164 (for which see FIG. 11). The result is to produce a non-zero positive potential at node 200. If, however, transistor 192 becomes conductive because motor current i is continuously too high, the potential of node 200 is then reduced, and a FAULT signal is produced as a result.

PWM pulses 164 thus travel via control line 90 to rotation speed controller 152; and in the event of malfunctions, the fact that transistor 192 becomes conductive allows a fault signal to travel in the opposite direction from motor 20 to control device 156.

To prevent an excessively high current i from flowing when motor 20 is started, the voltage at resistor 184 is also conveyed to a control member 208 which, when it responds, limits current i in output stage 154 to a defined value. Control member 186 is deactivated during starting, i.e. only starting current limiter 208 is active at that time.

Line 188 is connected to the output of controller 152, to the output of current limiter 208, and to a diode member 209. If controller 152, control member 186, or current limiter 208 generates a low potential at its output, diode member 209 then becomes conductive, reduces the voltage on line 177, and thereby blocks output stage 154 completely or partially, so that either motor 20 receives zero current or (during starting) motor current i is limited.

Manner of Operation of FIG. 10

The target rotation speed of motor 20 is defined by means of a DC voltage (in this case 2-7 V) at input 90 or by means of pulse duty ratio pwm of PWM signal 164. As long as the latter is less than 10%, motor 20 is stationary. In the range from 30 to 85%, the rotation speed increases. At a pulse duty ratio above 95%, the motor is switched off by way of switching member 160, as already described.

At startup, motor current i is limited by control member 208 to a defined maximum value, by the fact that diode member 209 correspondingly reduces the control signal for output stage 154 if starting current i becomes too high.

If motor 20 becomes jammed, current i rises sharply; this overcurrent causes control member 186, via diode member 209 and output stage 154, to shut off motor 20 for e.g. 13 seconds and then to switch motor 20 on for e.g. two seconds in order to attempt a restart of the motor. This periodic switching on and off prevents motor 20 and its output stage 154 from overheating if motor 20 is prevented from rotating.

The periodic signal generated in this context by control member 186 is also conveyed via line 190 to npn transistor 192, and causes the latter to switch on and off periodically. As a result, the potential at point 90 also changes periodically and is transferred via control line 90' to control device 156, where it generates the FAULT signal already described.

FIG. 11 shows a brushless motor 20 having two stator winding phases 220, 222 that are each connected in series with a power transistor 224 and 226, respectively. For commutation, these are controlled in the usual way via their bases by Hall IC 50 (FIG. 10); this is not depicted in FIG. 11. The base of transistor 224 is connected to the anode of a diode 228, and that of transistor 226 to the anode of a diode 230. The cathodes of diodes 228, 230 are connected to a line 232. Line 232 is connected to the collectors of two npn transistors 234, 236 whose emitters are connected to ground 88.

When one of transistors 234, 236 becomes conductive, a connection is created from the base of transistors 224, 226 to ground, so that these transistors are blocked and motor 20 no longer receives current. If one of transistors 234, 236 becomes only partially conductive, it then reduces the base current of transistors 224, 226 so that motor current i correspondingly decreases. This occurs in the context of current limiting, principally when motor 20 is started.

The emitters of transistors 224, 226 are connected to ground 88 via a node 240 and measuring resistor 184. The potential at node 240 is conveyed via a resistor 242 to the base of transistor 236, so that the latter acts as a current limiter: as the voltage at resistor 184 increases, transistor 236 becomes increasingly conductive and thereby limits motor current i, for example to a maximum value of approximately 0.5 A at startup.

The potential at node 240 is also conveyed to the positive input of an operational amplifier 244, whose negative input is connected to a node 246 that is connected via a resistor 248 to ground 88 and via PTC resistor 180 and a resistor 250 to line 174.

Output 252 of operational amplifier 244 is connected via a capacitor 254 (e.g. 2.2 uF) to the positive input, via a resistor 256 (e.g. 100 kOhm) to node 246, via a resistor 258 to the base of transistor 234, via a capacitor 260 (e.g. 1 nF) to ground 88, and via a resistor 262 to the base of transistor 192. The base of transistor 234 is also connected via a resistor 264 to ground 88.

If motor current i becomes continuously too high due to mechanical jamming of motor 20, operational amplifier 244 switches its output 252 to High; as a result, transistor 234 becomes conductive and, as described, cuts off current to motor 20. At the same time, transistor 192 is also switched on via resistor 262 and produces a low potential on control line 90.

Once operational amplifier 244 has switched over, it remains in that state for approximately 13 seconds because of the effect of capacitor 254 and then switches back into the state in which its output is low, so that transistors 192 and 234 are again blocked and motor 20 once again receives current. If the latter is still jammed, it is switched on for approx. two seconds and, if it does not start, is again made currentless for 13 seconds.

If motor 20 becomes too hot because of overload and/or elevated ambient temperature (in summer), the resistance of PTC resistor 180 becomes high; the result is that the potential at node 246 drops and also that transistors 192 and 234 are switched on, and motor 20 is made currentless until the temperature at PTC resistor 180 has once again decreased sufficiently.

Rotation speed controller 152 operates by comparing signals $n_{ist}$ and $n_{soll}$. It has for that purpose an operational amplifier 152K to which these signals are conveyed. If the rotation speed of motor 20 is too high, output 270 of operational amplifier 152K then becomes high, and that signal is transferred via a resistor 272 to the base of transistor 236, makes it conductive, and thereby influences transistors 224, 226 so that motor current i (and thus the rotation speed of motor 20) decreases.

Control line 90 is connected via a resistor 276 to line 174 and via a resistor 278 to a node 280 that is connected via a capacitor 282 to ground 88 and via a resistor 284 to the negative input of operational amplifier 152K. That negative input is also connected via a resistor 286 to ground.

Control line 90 is connected via a resistor 290 to the base of a pnp transistor 292 whose emitter, like the emitter of a pnp transistor 294, is connected to line 174.

The collector of transistor 292 is connected via a resistor 296 to ground 88, and via a capacitor 298 to its base. That base is also connected via a resistor 300 to the collector of transistor 294, which is connected via a resistor 302 to the base of transistor 236.

When transistor 294 is conductive, it conveys a base current to transistor 236 and thereby blocks transistors 224, 226 so that motor 20 receives no current.

As long as the pulse duty ratio of the PWM signal (cf. 164 in FIG. 10) on control line 90 is in the range from 30 to 85%, capacitor 282 is continuously discharged by the PWM pulses to a sufficient extent that transistor 292 is kept conductive by the potential on control line 90 and consequently blocks transistor 294.

If the pulse duty ratio of the PWM signal on control line 90 exceeds a value of 95%, or if control line 90' (FIG. 10) is interrupted (which corresponds in effect to a pulse duty ratio of 100%), capacitor 282 is charged to a higher voltage that is determined by resistors 276, 278, 284, 286; as a result, transistor 292 is blocked, and transistor 294 becomes conductive and shuts off motor 20 in the manner described.

An interruption of control line 90' (FIG. 10) therefore causes motor 20 to come to a stop, whereas without circuit 160 it would run at maximum speed.

In this fashion it is possible to transfer signals via control line 90 in both directions, i.e. signals which control motor 20 (PWM signals 164 or a control DC voltage) in the direction toward motor 20, and a fault signal (if motor 20 is rotating too slowly or is being prevented from rotating) in the opposite direction.

Figure 12:
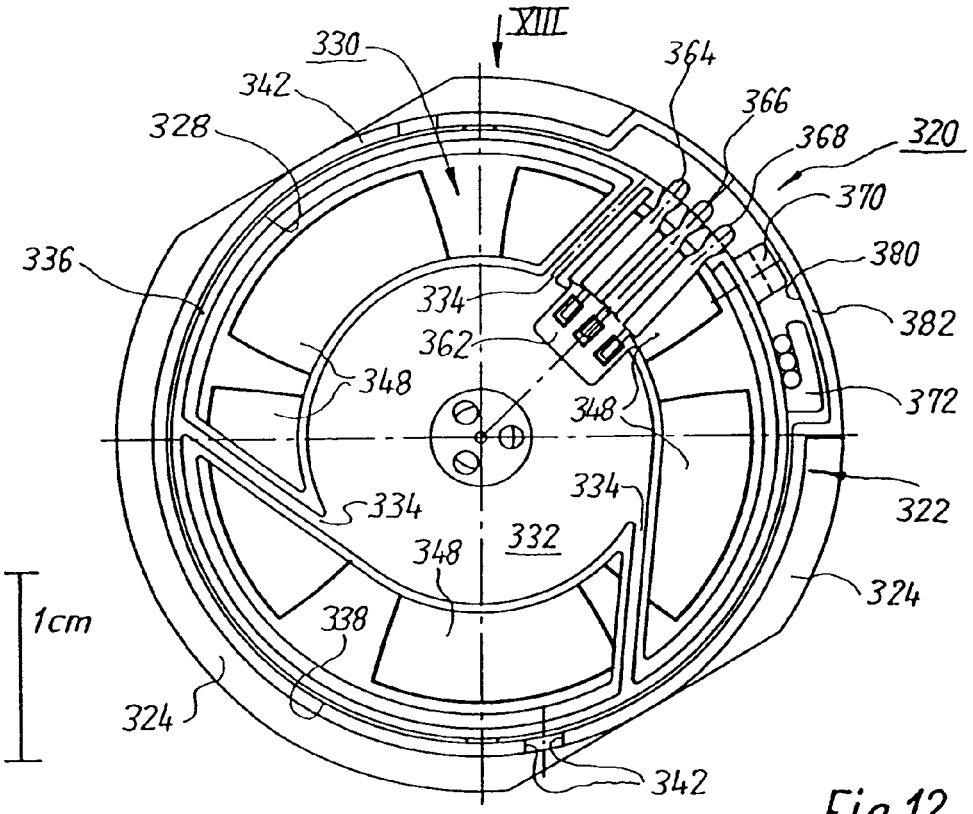
FIG. 12 is a plan view of an equipment fan 320 according to a second exemplary embodiment of the invention, viewed in the direction of an arrow XII of FIG. 13.
Figure 13:
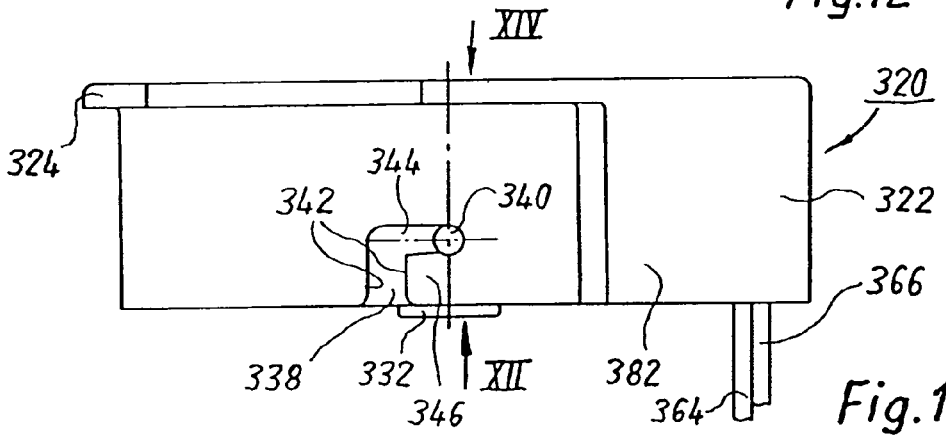
FIG. 13 is a side view, viewed in the direction of arrow XIII of FIG. 12.
Figure 14:
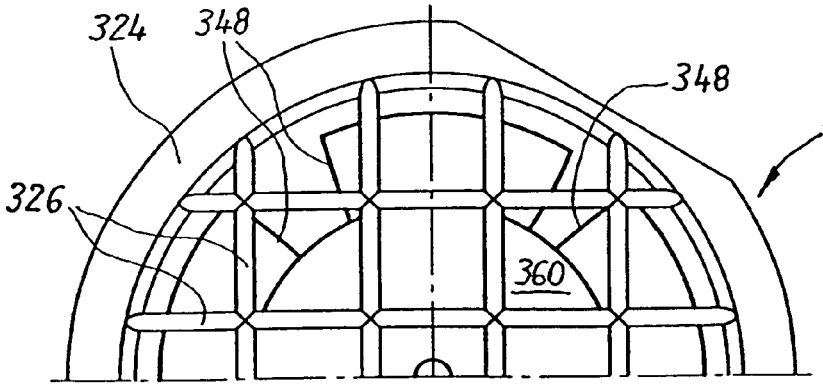
FIG. 14 is a plan view, viewed in the direction of arrow XIV of FIG. 13.

FIGS. 12 through 15 show a second exemplary embodiment of an equipment fan 220 according to the present invention, which here is very small and has an outside diameter of approx. 4 cm. In FIGS. 12 through 14, a common reference scale of 1 cm is indicated by way of example in order to illustrate typical size relationships.

Exactly as in the case of the fan shown in FIGS. 1 through 9, here again equipment fan 320 is assembled from two parts, namely an outer housing 322 which is equipped externally with a flange 324 that is configured integrally with a protective lattice 326, and which has a substantially cylindrical opening 328 into which the actual fan 330 is inserted and locked.

Fan 330 has a hub 332 that is connected via three struts 334 to a tubular outer part 336 whose outer side 338 fits with a sliding fit into opening 328.

Provided on outer side 328 with a 180-degree spacing are two radially projecting pegs 340, of which only one is depicted (in FIG. 13); provided in outer housing 322 to receive them are two guide openings 342 which in plan view (as in FIG. 13) are approximately L-shaped, i.e. proceeding from a lateral orifice, this opening extends first axially and then radially in a portion 344 that tapers toward its end into a latch opening into which (as shown in FIG. 13) peg 340 can be snap-locked. A wall portion 346 can yield elastically upon snap-locking or unsnapping. This solution is obviously simpler than the one shown in FIGS. 1 through 9.

Figure 15:
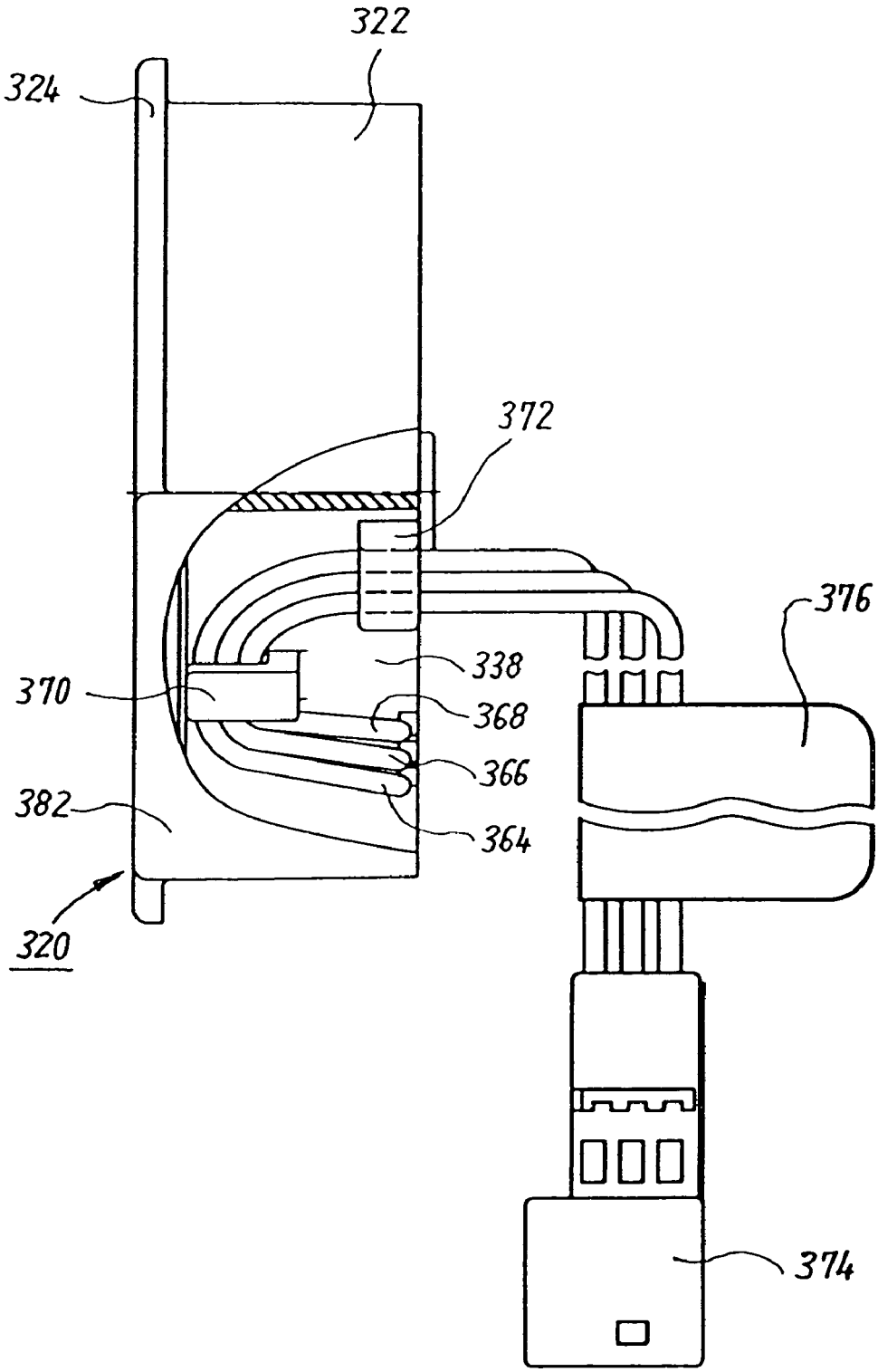
FIG. 15 is a side view, depicted partly in section, which depicts the routing of the electrical connecting lines.

Fan 330 has five fan blades 348 that are mounted on an external rotor 360. Three lines 364, 366, 368 are provided for electrical connection of internal stator 362; they lead in this case to an electronic system (not depicted) outside fan part 330, since with such a small equipment fan the electronics would not have enough room in fan 330 itself. As FIG. 15 shows, lines 364, 366, 368 are guided around two holding parts 370, 372 (on the outer side of tube 338) to a plug 374. A label is designated 376.

For the reception of lines 364, 366, 368 and holding parts 370, 372, outer housing 322 is here again equipped with a radial enlargement 380 whose cover is labeled 382. Its radial extension allows fan part 330 to rotate in outer housing 322 to the extent necessary for locking and unlocking.

In the interest of brevity, the reader is referred to the first exemplary embodiment (FIGS. 1 through 9) for an explanation of the manner of operation of the second exemplary embodiment (FIGS. 12 through 15). In the context of the second exemplary embodiment as well, fan part 330 can very easily be inserted into and removed from outer housing 322, which in many cases represents a considerable simplification upon installation.

Numerous variations and modifications are of course possible in the context of the present invention. For example, latch protrusions 94 can be provided on the inner side of opening 114, and casing part 76 can have corresponding latch openings. In the context of FIGS. 10 and 11, functions that are not desired by the customer can be omitted, and additional functions can alternatively be added.

Figure 16:
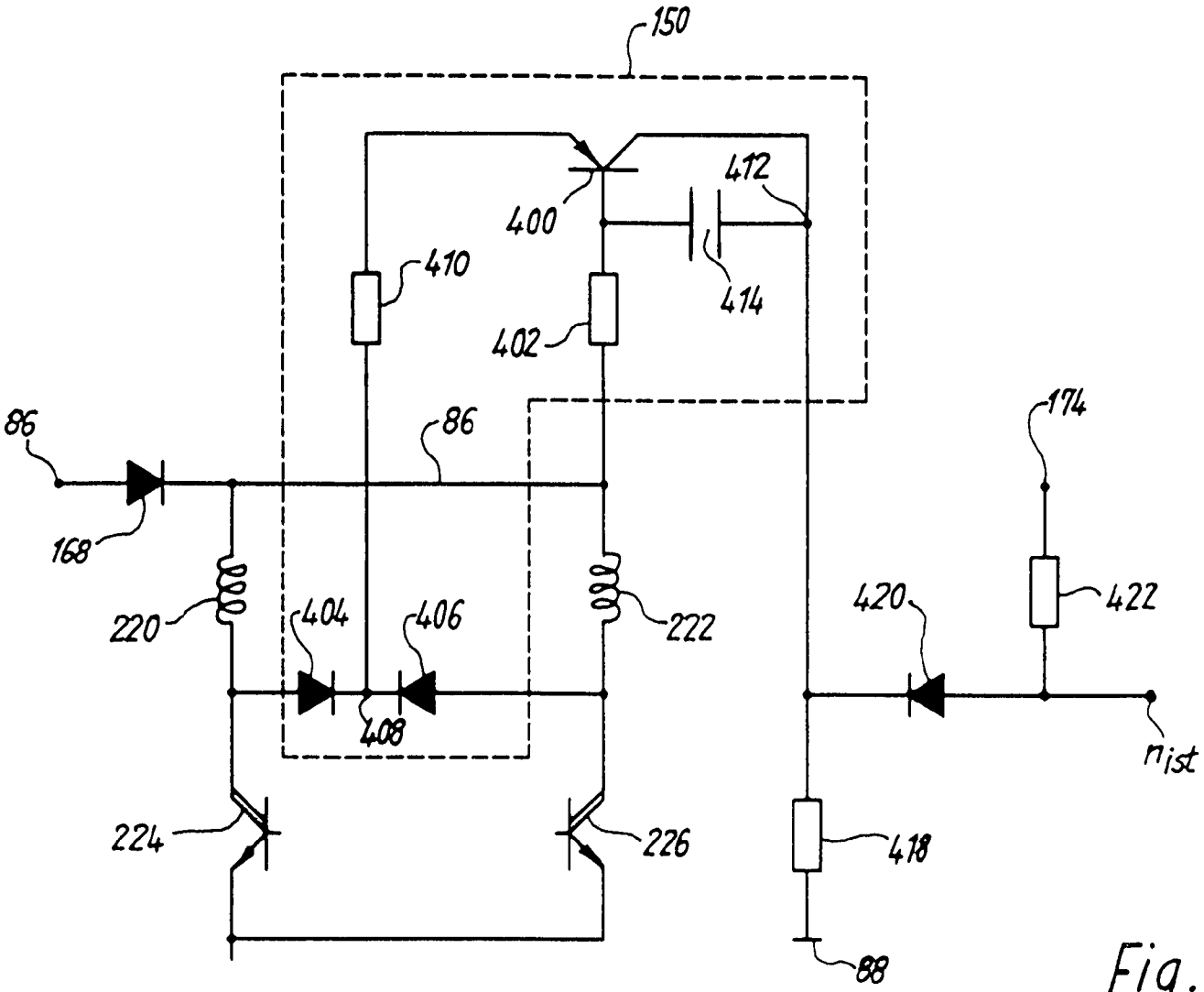
FIG. 16 shows a preferred exemplary embodiment of apparatus 150 of FIG. 11.

FIG. 16 shows an embodiment for generating a signal corresponding to the actual rotation speed $n_{ist}$ (cf. FIGS. 10 and 11). Identical or identically functioning parts are labeled with identical reference characters.

Circuit 150 comprises an amplification member in the form of a pnp transistor 400 (preferably BC856B) whose base is connected via a resistor 402 (preferably 1 kOhm) to positive line 86; an outcoupling apparatus 404, 406 in the form of two diodes 404, 406 (preferably BAV70), whose anodes are connected respectively to the sides of stator winding phases 220, 222 opposite to the side connected to positive line 86 and whose cathodes are connected to a node 408; a resistor 410 (preferably 39 kOhm) which is arranged between node 408 and the emitter of transistor 400; and a smoothing apparatus in the form of a capacitor 414 (preferably 100 nF), which capacitor 414 is arranged between the base and collector of transistor 400. The collector of transistor 400 is connected via a resistor 418 (preferably 36 kOhm) to ground line 88, in which context a rotation-speed-dependent voltage that is proportional to the rotation speed can be picked off at a node 412 between the collector of transistor 400 and resistor 418.

The base of transistor 400 is connected via resistor 402 to positive line 86. As soon as one of transistors 224, 226 (for example, transistor 224) opens during operation, phase 220 operates in generator mode; and because of the voltage proportional to rotation speed $n_{ist}$ that is induced in stator winding phase 220, which voltage is added to the potential of positive line 86, the potential at node 408 becomes greater than the potential on positive line 86.

As a result, transistor 400 (operating as an amplification member) becomes conductive, and a current flows through resistor 410, transistor 400, and resistor 418 to ground line 88.

This current has a ripple corresponding to the voltage induced in stator winding phase 220. That ripple is eliminated by an alternating current feedback using capacitor 414, so that a direct current which is proportional to the rotor rotation speed flows through resistor 418 to ground line 88. A potential proportional to the rotor rotation speed is thus obtained at node 412.

The diode voltage of diode 420 is added to the potential at node 412 via diode 420 and resistor 422, and the result is conveyed via output $n_{ist}$ to operational amplifier 152 (cf. FIG. 11).

The advantage of this circuit 150 is that it functions independently of the magnitude of operating voltage 86 being used, and supplies a signal $n_{ist}$ that is proportional to the instantaneous rotation speed of motor 20.

It will be apparent to those skilled in the art that various changes and modifications are possible within the scope of the inventive concept. For example, features of one embodiment could be combined with features of another embodiment. Therefore, the invention is not limited to the specific embodiments shown and described, but rather is defined by the following claims.

What is claimed is:

1. An equipment fan, comprising a fan wheel (46; 348) adapted to be driven by an external-rotor motor (20) whose internal stator (60; 362) is mounted on a hub (22; 332) which in turn is connected via at least one strut (74; 334) to an approximately cylindrical casing part (76; 336) that surrounds an outer side of the fan wheel (46; 348) at a distance; and a housing (110; 322) that is configured for releasable reception of said casing part (76; 336) and in turn is configured for mounting on an object (136, 138), and wherein a protrusion (98; 340) is provided on the outer side of the casing part (76; 336);

and there is provided in the housing (110; 322) a member (120, 122, 124; 342, 344) for latching of said protrusion (98; 340), into which said protrusion (98; 340) snap-locks when the casing part (76; 336) and the housing (110; 322) are in a predefined position relative to each other.

2. The equipment fan according to claim 1, wherein there is provided, on the hub (22; 332), an electrical connecting line (86, 88, 90; 364, 366, 368) for the securing of which on the outer side (338) of the casing part (76; 336) therein is provided at least one holding element (92, 94; 370, 372), said connecting line (86, 88, 90; 364, 366, 368) extending from the hub (22; 332) to the outer side of the casing part (76; 336) and to the at least one holding element (92, 94; 370, 372) provided there.

3. The equipment fan according to claim 2, wherein an opening (126; 380), for reception of the at least one holding element (92, 94; 370, 372) and of the connecting line (86, 88, 90; 364, 366, 368) held on it, is formed on an inner side of the housing (110; 322).

4. The equipment fan according to claim 1, wherein the member serving for latching is configured as a resilient latching member (120, 122, 124; 346) into which the protrusion (98; 340) can be introduced and snap-locked by a combination of axial motion and rotary motion of the casing part (76; 336) relative to the housing (110; 322).

5. The equipment fan according to claim 1, wherein the housing (110; 322) is equipped on one side with a housing protective lattice (112; 326) for the passage of air.

6. The equipment fan according to claim 5, wherein the hub (22; 332) and casing part (76; 336) are equipped, on a side facing away from the housing protective lattice (112; 326), with a protective lattice (74, 80; 334), so that after the casing part (76; 336) and housing (110; 322) are joined, the equipment fan has a protective lattice on both sides.

7. The equipment fan according to claim 6, wherein the protective lattice (74, 80) provided on the hub (22) and casing part (76) are formed with openings which enable a fingertip to be inserted so as to make possible, by manual grasping of said protective lattice (74, 80), a motion of the casing part (76) relative to the housing (110).

8. The equipment fan according to claim 1, wherein for releasable reception of the casing part (76; 336), the housing (110; 322) at least locally comprises a substantially cylindrical opening (114; 328).

9. The equipment fan according to claim 1, wherein the housing (110), viewed in the axial direction of the fan, has an approximately rectangular outer contour.

10. The equipment fan according to claim 1, wherein a holding device (132) for a connector (96), which connector is provided on an electrical connecting line (86, 88, 90) of the external-rotor motor (20), is provided on the housing (110).

11. An equipment fan comprising:

a fan wheel (46; 348) adapted to be driven by an external-rotor motor (20) whose internal stator (60; 362) is mounted on a hub (22; 332) which in turn is connected via at least one strut (74; 334) to an approximately cylindrical casing part (76; 336) that surrounds an outer side of the fan wheel (46; 348) at a distance; and a housing (110; 322) that is configured for releasable reception of said casing part (76; 336) and in turn is configured for mounting on an object (136, 138), said housing being equipped on one side with a housing protective lattice (112; 326) for the passage of air; and wherein the hub (22; 332) and casing part (76; 336) are equipped, on a side facing away from the housing protective lattice (112; 326), with a protective lattice (74, 80; 334), so that, after the casing part (76; 336) and housing (110; 322) are joined, the equipment fan has a protective lattice on both sides;

the protective lattice (74, 80) provided on the hub (22) and casing part (76) are provided with at least one mark (82, 84, 122) which indicates the opening and/or closing direction in which the casing part (76) must be rotated, relative to the housing (110), in order to initiate the relevant operation.

12. The equipment fan according to claim 11, wherein there is provided, on the hub (22; 332), an electrical connecting line (86, 88, 90; 364, 366, 368) for the securing of which on the outer side (338) of the casing part (76; 336) therein is provided at least one holding element (92, 94; 370, 372), said connecting line (86, 88, 90; 364, 366, 368) extending from the hub (22; 332) to the outer side of the casing part (76; 336) and to the at least one holding element (92, 94; 370, 372) provided there.

13. The equipment fan according to claim 12, wherein an opening (126; 380), for reception of the at least one holding element (92, 94; 370, 372) and of the connecting line (86, 88, 90; 364, 366, 368) held on it, is formed on an inner side of the housing (110; 322).

14. The equipment fan according to claim 11, wherein a protrusion (98; 340) is provided on the outer side of the casing part (76; 336);

and there is provided in the housing (110; 322) a member (120, 122, 124; 342, 344) for latching of said protrusion (98; 340), into which said protrusion (98; 340) snap-locks when the casing part (76; 336) and the housing (110; 322) are in a predefined position relative to each other.

15. The equipment fan according to claim 14, wherein the member serving for latching is configured as a resilient latching member (120, 122, 124; 346) into which the protrusion (98; 340) can be introduced and snap-locked by a combination of axial motion and rotary motion of the casing part (76; 336) relative to the housing (110; 322).

16. The equipment fan according to claim 11, wherein the protective lattice (74, 80) provided on the hub (22) and casing part (76) are formed with openings which enable a fingertip to be inserted so as to make possible, by manual grasping of said protective lattice (74, 80), a motion of the casing part (76) relative to the housing (110).

17. The equipment fan according to claim 11, wherein for releasable reception of the casing part (76; 336), the housing (110; 322), at least locally, comprises a substantially cylindrical opening (114; 328).

18. The equipment fan according to claim 17, wherein the approximately cylindrical opening (114; 328) at least locally comprises an interruption (118; 342) in order to permit the introduction there of a protrusion (98; 340) provided on the outer side of the casing part (76; 336).

19. The equipment fan according to claim 18, wherein the interruption (118; 342) of the approximately cylindrical opening (114; 328) comprises a resilient latching member (122, 124; 346) which enables snap-locking of the protrusion (98; 340) provided on the casing part (76; 336) by means of a relative rotation between the housing (110; 322) and casing part (76; 336).

20. The equipment fan according to claim 11, wherein the housing (110), viewed in the axial direction of the fan, has an approximately rectangular outer contour.

21. The equipment fan according to claim 20, wherein a portion (116) of the housing (110) forming an approximately cylindrical opening (114) projects, at least locally, beyond the rectangular outer contour.

22. The equipment fan according to claim 11, wherein a holding device (132) for a connector (96), which connector is provided on an electrical connecting line (86, 88, 90) of the external-rotor motor (20), is provided on the housing (110).

23. An equipment fan comprising:

a fan wheel (46; 348) adapted to be driven by an external-rotor motor (20) whose internal stator (60; 362) is mounted on a hub (22; 332) which in turn is connected via at least one strut (74; 334) to an approximately cylindrical casing part (76; 336) that surrounds an outer side of the fan wheel (46; 348) at a distance; and a housing (110; 322) that is configured for releasable reception of said casing part (76; 336) and in turn is configured for mounting on an object (136, 138), wherein for releaseable reception of the casing part (76; 336), the housing (110; 322), at least locally, is formed with a substantially cylindrical opening (114; 328); and the approximately cylindrical opening (114; 328), at least locally, has an interruption (118; 342) in order to permit the introduction there of a protrusion (98; 340) provided on the outer side of the casing part (76; 336).

24. The equipment fan according to claim 23, wherein the interruption (118; 342) of the approximately cylindrical opening (114; 328) comprises a resilient latching member (122, 124; 346) which enables snap-locking of the protrusion (98; 340) provided on the casing part (76; 336) by means of a relative rotation between the housing (110; 322) and casing part (76; 336).

25. The equipment fan according to claim 23, wherein the interruption (118; 342) of the approximately cylindrical opening (114; 328) comprises a resilient latching member (122, 124; 346) which enables snap-locking of the protrusion (98; 340) provided on the casing part (76; 336) by means of a relative rotation between the housing (110; 322) and casing part (76; 336).

26. The equipment fan according to claim 23, wherein the housing (110), viewed in the axial direction of the fan, has an approximately rectangular outer contour.

27. The equipment fan according to claim 26, wherein a portion (116) of the housing (110) forming the approximately cylindrical opening (114) projects, at least locally, beyond the rectangular outer contour.

28. The equipment fan according to claim 23, wherein a holding device (132) for a connector (96), which connector is provided on an electrical connecting line (86, 88, 90) of the external-rotor motor (20), is provided on the housing (110).

29. An equipment fan comprising:

a fan wheel (46; 348) adapted to be driven by an external-rotor motor (20) whose internal stator (60; 362) is mounted on a hub (22; 332) which in turn is connected via at least one strut (74; 334) to an approximately cylindrical casing part (76; 336) that surrounds an outer side of the fan wheel (46; 348) at a distance; and a housing (110; 322) that is configured for releasable reception of said casing part (76; 336) and in turn is configured for mounting on an object (136, 138), the housing (110), viewed in the axial direction of the fan, has an approximately rectangular contour; and wherein a portion (116) of the housing (110) forming the approximately cylindrical opening (114) projects, at least locally, beyond the rectangular outer contour.

30. The equipment fan according to claim 29, wherein a holding device (132) for a connector (96), which connector is provided on an electrical connecting line (86, 88, 90) of the external-rotor motor (20), is provided on the housing (110).

* * * * *

UNITED STATES PATENT AND TRADEMARK OFFICE

CERTIFICATE OF CORRECTION

PATENT NO. : 7,352,094 B2
APPLICATION NO. : 10/982307
DATED : April 1, 2008
INVENTOR(S) : Wolfgang Arno Winkler It is certified that error appears in the above-identified patent and that said Letters Patent is hereby corrected as shown below:

On the Title Page, Item (30) should read,

Foreign Applications

GERMANY 201 19 155.5 11/26/2001

GERMANY 202 10 846.5 7/18/2002

Signed and Sealed this

Thirtieth Day of September, 2008

JON W. DUDAS
*Director of the United States Patent and Trademark Office*